United States Patent [19]

Dahlgren

[11] Patent Number: 4,894,041

[45] Date of Patent: Jan. 16, 1990

[54] TOY BOAT

[75] Inventor: Lennart Dahlgren, Askim, Sweden

[73] Assignee: Aqua Toys AB, Askim, Sweden

[21] Appl. No.: 251,997

[22] Filed: Sep. 30, 1988

Related U.S. Application Data

[63] Continuation of Ser. No. 844,501, Jul. 11, 1986, abandoned.

[51] Int. Cl.[4] ..... A63H 23/02; A63H 23/00

[52] U.S. Cl. ..... 446/160; 446/153; 114/357; D21/130; D21/71; D12/300

[58] Field of Search ..... 446/160, 161, 162, 163, 446/153, 154, 156, 6, 69, 85, 88, 93, 94, 95, 227, 396, 486, 471; D21/130, 71, 73, 76; D12/300, 301, 315, 316, 317, 318; 114/357, 182

[56] References Cited

U.S. PATENT DOCUMENTS

| | | | |
|---|---|---|---|
| D. 161,861 | 2/1951 | Mueller, Jr. | D21/130 X |
| D. 189,199 | 11/1960 | Allen et al. | D21/130 |
| D. 247,384 | 2/1978 | Nakao | D21/130 |
| D. 258,071 | 1/1981 | Walker | D21/130 |
| 1,096,100 | 5/1914 | Engelhardt et al. | 114/182 X |
| 1,449,030 | 3/1923 | Barney et al. | 446/163 |
| 1,511,798 | 10/1924 | Breslove | 446/160 |
| 2,124,062 | 7/1938 | Grant et al. | 272/1 B |
| 2,581,545 | 1/1952 | Long | D21/73 X |
| 3,126,669 | 3/1964 | Gausewitz | 446/160 |
| 3,321,784 | 5/1967 | Rasmussen | D12/316 X |
| 3,338,205 | 8/1967 | Leavitt | 114/182 |
| 3,497,887 | 3/1970 | Bureau, Jr. | 114/357 |
| 3,561,155 | 2/1971 | Tarrson | 446/160 X |
| 3,652,090 | 3/1972 | Semmens | 272/1 B X |
| 4,223,894 | 9/1980 | Fabricant | 446/160 X |
| 4,313,277 | 2/1982 | Klawitter | 446/163 |
| 4,673,370 | 6/1987 | Goldfarb et al. | 446/160 X |
| 4,678,451 | 7/1987 | Ventura | 446/471 |
| 4,723,930 | 2/1988 | Freese et al. | 446/160 X |

FOREIGN PATENT DOCUMENTS

| | | | |
|---|---|---|---|
| 0147986 | 9/1982 | Japan | 114/182 |
| 775707 | 5/1957 | United Kingdom | 446/160 |
| 1136333 | 12/1968 | United Kingdom | 114/357 |

*Primary Examiner*—Robert A. Hafer
*Assistant Examiner*—D. Neal Muir
*Attorney, Agent, or Firm*—Cushman, Darby & Cushman

[57] ABSTRACT

A toy boat of the type where the hull (11) of the boat is constituted of a closed hollow body produced by means of blow moulding of a thermoplastic material in a mould, the parting line (13) of which is situated in the vertical longitudinal metacenter plane of the boat. The purpose is to provide a complete toy boat produced by means of the blow moulding method without movable cores and which boat hull in finished design present such details as gunwale, bulwark, tow hooks etcetera, which can have a colour contrasting to the colour of the boat hull. This has been achieved thereby that boat details situated laterally to the opening direction of the mould, such as the gunwale (15) of the boat, the bulwarks (14,27) etcetera, are produced by blow moulding as one or more separate units shaped as a ring (12) surrounding the peripheral outer edge of each such boat detail, said ring being arranged to be detachably attached to the boat hull (11), in that the hull is equipped with portions (22,23) adapted for cooperation with corresponding recesses (24,25) in the ring (12) for positional location of the ring relative to the hull (11). (FIG. 1)

2 Claims, 2 Drawing Sheets

TOY BOAT

This is a continuation of application Ser. No. 06/844,501, filed July 11, 1986, which was abandoned upon the filing hereof.

The present application relates to a toy boat of the type where the hull of the boat is a closed hollow body produced by means of blow moulding of a thermoplastic material in a mould, the parting line of which is situated in the vertical longitudinal metacenter plane of the boat.

BACKGROUND OF THE INVENTION

Toy boats produced by injection moulding, e.g. from PVC, are known. The manufacturing method and the requirement for a nonexpensive product dictate that the design of the product must be subjected to the blow moulding technique, i.e. the blow moulded object can have no parts projecting laterally to the opening direction of the mould. This means that such hollow bodies, even when regarded as toys, in certain cases can only with difficulty be identified for what they represent, particularly when it is a more complex configuration, which is often the case with boats, such as complete fishing boats, tugboats, passenger boats, etcetera. The possibility which has hitherto been available is to use moulds having one or more loose or displaceable cores, which after the blow moulding, is pulled out to allow the blow moulded body to be removed from the mould. Such a mould however is considerably more expensive to obtain, which means that also the product will be more expensive. The blow moulded object furthermore will have the same colour through-out its entire surface so that if it is desired that certain details have other colours, is it necessary for the object to be subjected to a painting procedure.

BACKGROUND OF THE INVENTION

The purpose of the present application is to provide a toy boat, which because of the construction of the boat hull can utilize the simple blow moulding method without movable cores and which boat hull in finished condition has details, such as the boats, gunwale, bulwark, tow hooks, etcetera situated laterally to the opening direction of the mould. These details furthermore can be given a colour contrasting to that of the boat hull. This has been achieved because the boat details which are situated laterally to the opening direction of the mould, such as the gunwale of the boat, the bulwarks etcetera, are produced by blow moulding as one or more separate units shaped as a ring surrounding the peripheral outer edge of each such boat detail. The ring is arranged to be detachably attached to the boat hull. The hull is equipped with portions adapted for cooperation with corresponding recesses in the ring for positional location of the ring relative to the hull.

DETAILED DESCRIPTION

The toy boat according to the invention is manufactured from two parts, a boat hull part 11 and a bulwark or gunwale part 12. The hull part 11 is a closed hollow body produced by blow moulding from a thermoplastic material, e.g. polyethylene. The boat hull 11 has been given such an exterior surface that the mould for production of the hull has its parting line located in the vertical longitudinal metacenter plane 13 of the boat. This means that each hull half on each side of the said metacenter plane 13 must be designed in such a manner that it releases the mould when the mould halves are pulled apart after blow moulding is completed.

Figure 4:
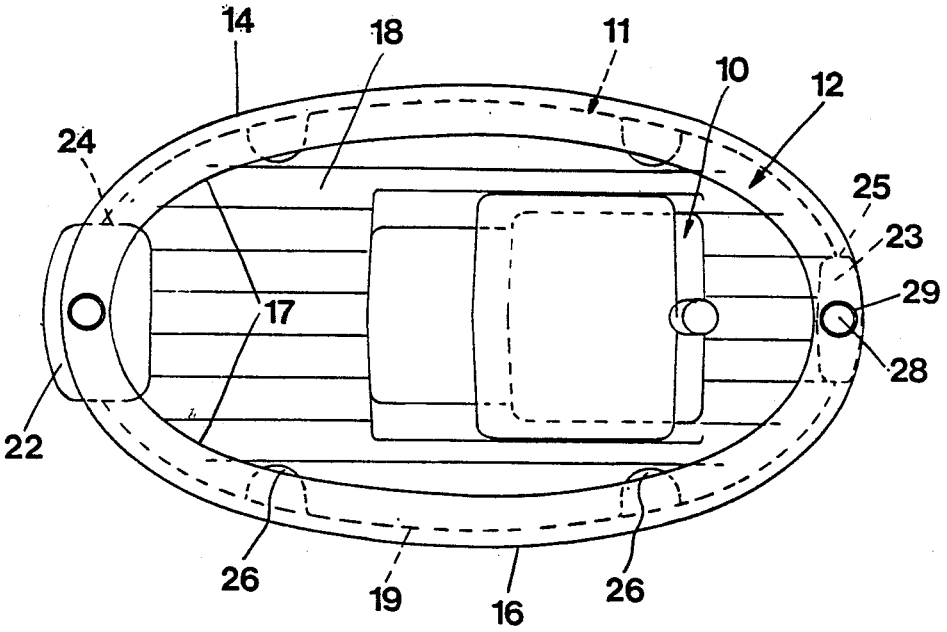
FIG. 4 is a planar view of the fishing boat shown in FIGS. 2 and 3.
Figure 2:
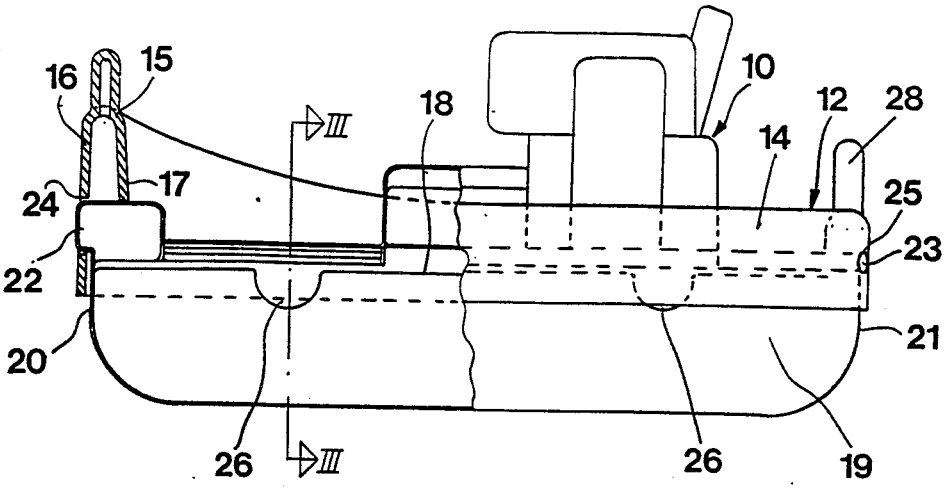
FIG. 2 shows in a sideview and partly in section a toy boat, representing a fishing boat according to the invention.
Figure 3:
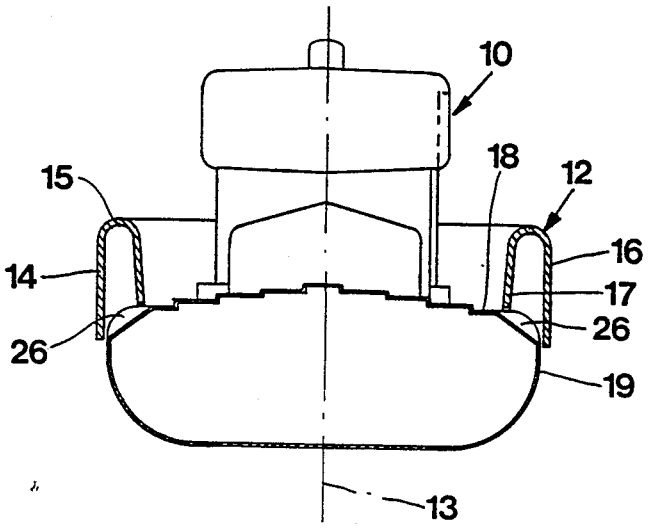
FIG. 3 is a section along line III—III in FIG. 2.

The second part 12, which shall form the bulwark 14 of the boat together with gunwale 15, is produced by means of injection moulding and is made as an oval ring 12 having a shape being a complement of the shape of the hull periphery. The ring 12 has a U-shaped cross section, whereby the U has a longer, outer shank 16 and a shorter, inner shank 17, which shanks are both designed and arranged in such a manner that the shorter shank 17 rests against the deck 18 of the boat hull, and the outer shank 16 engages the outer skin 19 of the boat hull 11. The oval ring 12 is connected in an appropriate manner to the boat hull 11, which connection can be either permanent by the parts being spot welded, glued or otherwise being connected to each other or the connection can be detachable, e.g. a snap-type connection. Such a connection is shown in the embodiment according in FIGS. 2–4 where the stem 20 and stern post 21 of the boat hull 12 are equipped with projecting portions 22,23 intended to be pushed into corresponding apertures 24,25 in the oval ring 12. By hooking the portion 22 into the aperture 24 the opposite end of the ring can be pushed over the stern post 21, thus the aperture 25 snaps over the projecting portion 23. In this manner a simple attachment is obtained without any extra steps whatsoever.

For ascertaining that the boat shall not be water filled at play in water the area between the deck 18 and the bulwark 19 of the boat hull is provided with groove shaped cavities 26, which serve as drainage means for water that has collected on the deck 18.

Figure 1:
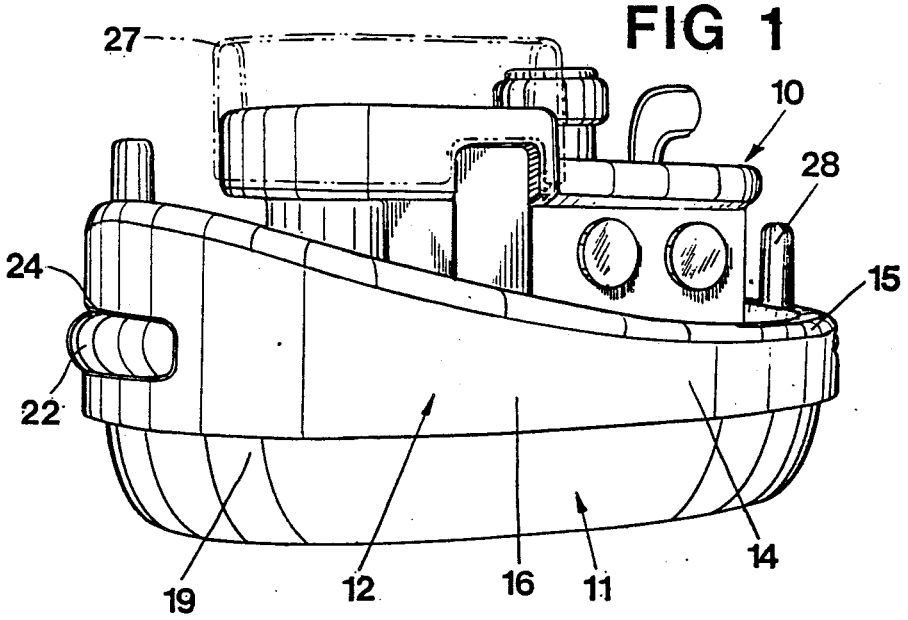
FIG. 1 shows in perspective a toy boat according to the invention, more distinctly a tugboat.

The invention is not limited to the embodiments shown but a plurality of variations are possible within the scope of the appended claims. The same idea thus can be used at other parts of the boat, e.g. a bulwark 27 can be provided on the roof of the bridge, such as shown in FIG. 1 with dash-and-dot lines. The stern mooring post 28, in a manner similar to the projections 22,23 and apertures 24,25, can be provided on the boat hull and in assembled position extend through a corresponding hole 29 in the oval ring 12.

I claim:

1. A toy boat comprising:

a hollow hull produced by blow moulding of a thermoplastic material in a mould, said hull comprising a deck having an outer perihery and an upper surface, an outer skin, a plurality of positional portions protruding from said outer skin and a bottom;

at least one ring forming a gunwale for said hull, said ring surrounding the outer periphery of said deck and an adjacent portion of said skin, said ring having a U-shaped cross section having a longer and a shorter shank, the latter having a lower end which rests on the upper surface of the deck of the hull, said ring further having a plurality of recesses cooperating with respective ones of said positional portions of said hull for detachably connecting said ring to said hull and positionally locating the ring relative to the hull.

2. A toy boat as in claim 4 wherein an area of the deck between the shorter shank of the ring and the outer skin of the hull under said ring has a plurality of groove-formed cavities formed therein as drainage means for drainage of water from the deck and under said ring.

* * * * *